US006745532B1

(12) United States Patent
Vazquez Ruiz del Arbol

(10) Patent No.: US 6,745,532 B1
(45) Date of Patent: Jun. 8, 2004

(54) PROCESS FOR THE ARTICULATED IMBRICATION OF CONCRETE SLABS ¢I(IN SITU)

(76) Inventor: Jose Ramon Vazquez Ruiz del Arbol, Hercegovina, 25,3°-1ª, 08006, Barcelona (ES)

( * ) Notice: Subject to any disclaimer, the term of this patent is extended or adjusted under 35 U.S.C. 154(b) by 0 days.

(21) Appl. No.: 09/720,957

(22) PCT Filed: Jul. 6, 1999

(86) PCT No.: PCT/ES99/00213

§ 371 (c)(1),
(2), (4) Date: Jan. 3, 2001

(87) PCT Pub. No.: WO00/01890

PCT Pub. Date: Jan. 13, 2000

(30) Foreign Application Priority Data

Jul. 7, 1998 (ES) ..... 9801429

(51) Int. Cl.[7] ..... E04C 2/06

(52) U.S. Cl. ..... 52/414; 52/299; 52/259; 52/332; 52/365; 52/370; 52/396.02; 52/588.1; 52/589.1; 52/590.1; 52/591.1; 52/592.1; 52/704; 52/745.05; 404/62; 404/65; 404/70; 404/74

(58) Field of Search ..... 52/299, 365, 370, 52/704, 396.02, 588.1, 589.1, 590.1, 259, 332, 414, 591.1, 591.2, 592.1, 745.05; 404/70, 62, 65, 74

(56) References Cited

U.S. PATENT DOCUMENTS

| | | | | | |
|---|---|---|---|---|---|
| 2,882,714 | A | * | 4/1959 | Gagle et al. | 52/604 |
| 3,437,017 | A | * | 4/1969 | Walz et al. | 94/8 |
| 3,513,609 | A | * | 5/1970 | Lang | 52/223.6 |
| 3,577,896 | A | * | 5/1971 | Finsterwalder | 94/24 |
| 3,702,093 | A | * | 11/1972 | Van de Loock et al. | 94/8 |
| 3,775,240 | A | * | 11/1973 | Harvery | 161/149 |
| 3,870,587 | A | * | 3/1975 | Merrell | 428/71 |
| 4,003,172 | A | * | 1/1977 | Pawl | 52/279 |
| 4,019,298 | A | * | 4/1977 | Johnson, IV | 52/590.1 |
| 4,287,693 | A | * | 9/1981 | Collette | 52/177 |
| 4,394,201 | A | * | 7/1983 | Haeussler | 156/73.6 |
| 4,449,844 | A | * | 5/1984 | Larsen | 404/60 |

FOREIGN PATENT DOCUMENTS

| | | |
|---|---|---|
| DE | 1221660 | 7/1966 |
| DE | 1279918 | 10/1968 |
| ES | 0438082 | 2/1977 |
| ES | 2114422 | 5/1998 |
| GB | 1489020 | 10/1997 |
| WO | 9641706 | 12/1996 |

OTHER PUBLICATIONS

English translation of WO 96/41706 dated Dec. 27, 1996.
English translation of DE 1279918 dated Oct. 10, 1968.
English translation of DE 1221660 dated Jul. 28, 1966.
English translation of ES 2114422 dated May 16, 1988.

*Primary Examiner*—Carl D. Friedman
*Assistant Examiner*—Christy M. Green
(74) *Attorney, Agent, or Firm*—Ladas & Parry

(57) ABSTRACT

The invention relates to the articulated imbrication of concrete slabs ¢i(in situ) wherein joints are formed by laying ¢i(in situ), along joint lines, a simple armored mesh device with a cut and fold pattern which has been already prepared in the workshop. Advantage is taken from the retraction phenomenon in order to achieve an alternative indentation along the joints of adjacent slabs of continuous cast concrete, susceptible of forming satisfactorily a knee—or gimbal-joint connection between the joints. The process is complemented with a concrete separator element which facilitates the formation of the crack and prevents water from reaching the platform, and which can be fixed to said device. The invention applies to concrete surface roads, highways and harbour zones of goods warehouses and enables to design and make road surfaces without bases and subbases.

6 Claims, 6 Drawing Sheets

U.S. PATENT DOCUMENTS 4,867,598 A * 9/1989 Winter, IV ..... 403/381
4,991,248 A * 2/1991 Allen ..... 14/73
5,106,227 A * 4/1992 Ahmad et al. ..... 404/70
5,183,694 A * 2/1993 Webb ..... 428/67
5,226,279 A * 7/1993 Rendon-Herrero ..... 52/741.41
5,349,797 A * 9/1994 Stultz ..... 404/64
5,513,925 A * 5/1996 Dempsey et al. ..... 404/17
6,357,194 B1 * 3/2002 Jones, Jr. ..... 52/590.1
6,389,774 B1 * 5/2002 Carpenter ..... 404/52
6,427,406 B1 * 8/2002 Weaver et al. ..... 52/414
6,455,127 B1 * 9/2002 Valtanen ..... 428/137
6,470,640 B2 * 10/2002 Ytterberg ..... 52/414
6,484,464 B1 * 11/2002 Ochoa ..... 52/414
6,568,139 B2 * 5/2003 Bot ..... 52/250
6,578,343 B1 * 6/2003 Dumler et al. ..... 52/783.17

* cited by examiner

PROCESS FOR THE ARTICULATED IMBRICATION OF CONCRETE SLABS ¢I(IN SITU)

FIELD OF THE INVENTION

Generally speaking, the present invention refers to an on-site articulated imbrication process between concrete slabs. More specifically, the invention refers to a joint formation process in on-site linear works and concrete paving like roads, streets, motorways, railways, channels and port and airport platforms together with the means for their execution.

BACKGROUND OF THE INVENTION

Amongst the devices known in the art for forming joints in concrete pavings, the following can be cited 1) The distribution blocks described in Spanish Patent 438.002.

2) The classic plastic coated steel pins located towards the middle of the slab thickness such as, for example, those described in U.S. Pat. No. 3,437,017, have the drawback of creating strong, localized pressure resulting in a clearance of the space they occupy in the concrete, hence reducing their effectiveness. For this reason, either large slab thicknesses are necessary or lower base and sub-base layers. Moreover, the insertion of lateral pins has not yet given a satisfactory result.

3. The undulated plates, vertically arranged on the ground and fastened to it, require lateral feeding, reducing works yield and making another lateral access necessary. This solution has not given the expected result since the intended formation of teeth is not achieved and hence, load transmission is not obtained.

4. My Spanish applications P-9402515 "Coplanar Coupling System Between Concrete Slabs" filed on Dec. 9th 1994, and P-9500530, "Joint System Between Concrete and Similar Slabs", filed on Mar. 9th 1995, and my application PCT/ES95/00072, "Construction Process for Linear Concrete Works With Internal Gaps and Execution Devices"; filed on Jun. 9th 1995. These systems require the load on the edges of adjacent slabs immediately after completing the superficial groove and before the concrete begins to shrink which sometimes causes more cracks than desirable, provoking the insecurity of these systems. The process described herein is produced in a fully natural or automatic way and therefore is safe.

BRIEF DESCRIPTION OF THE INVENTION

By means of a device, the described process, takes advantage of the concrete shrinking with the object of leaving the edges of the resulting slabs leaning over each other. It is complemented with a separating component preventing the arrival of water to the platform across these edges and may be fastened to the mentioned device.

The device is a corrugated steel mesh installed with its axis parallel and contained in the axis plane of the joint to be obtained. Cuts are made and several wires are bent, perpendicular to the mesh axis, towards the side where cuts have not been made, forming an angle. The wires existing outside are cut from the other side of the mesh axis and are bent in the opposite direction to the previous ones. Continuing in this manner, we obtain iron pieces alternatively inclined to one side or the other of the mesh axis, which will form part of the inclined support surfaces of a slab over the adjacent one. This mesh shape loads the cracks created through the upwards part downwards and the same is done for the cracks created from downwards upwards, forming a single crack.

BRIEF DESCRIPTION OF THE DRAWINGS

A detailed description of the invention is given below referring to the attached drawings where.

DETAILED DESCRIPTION OF THE INVENTION

Figure 1:
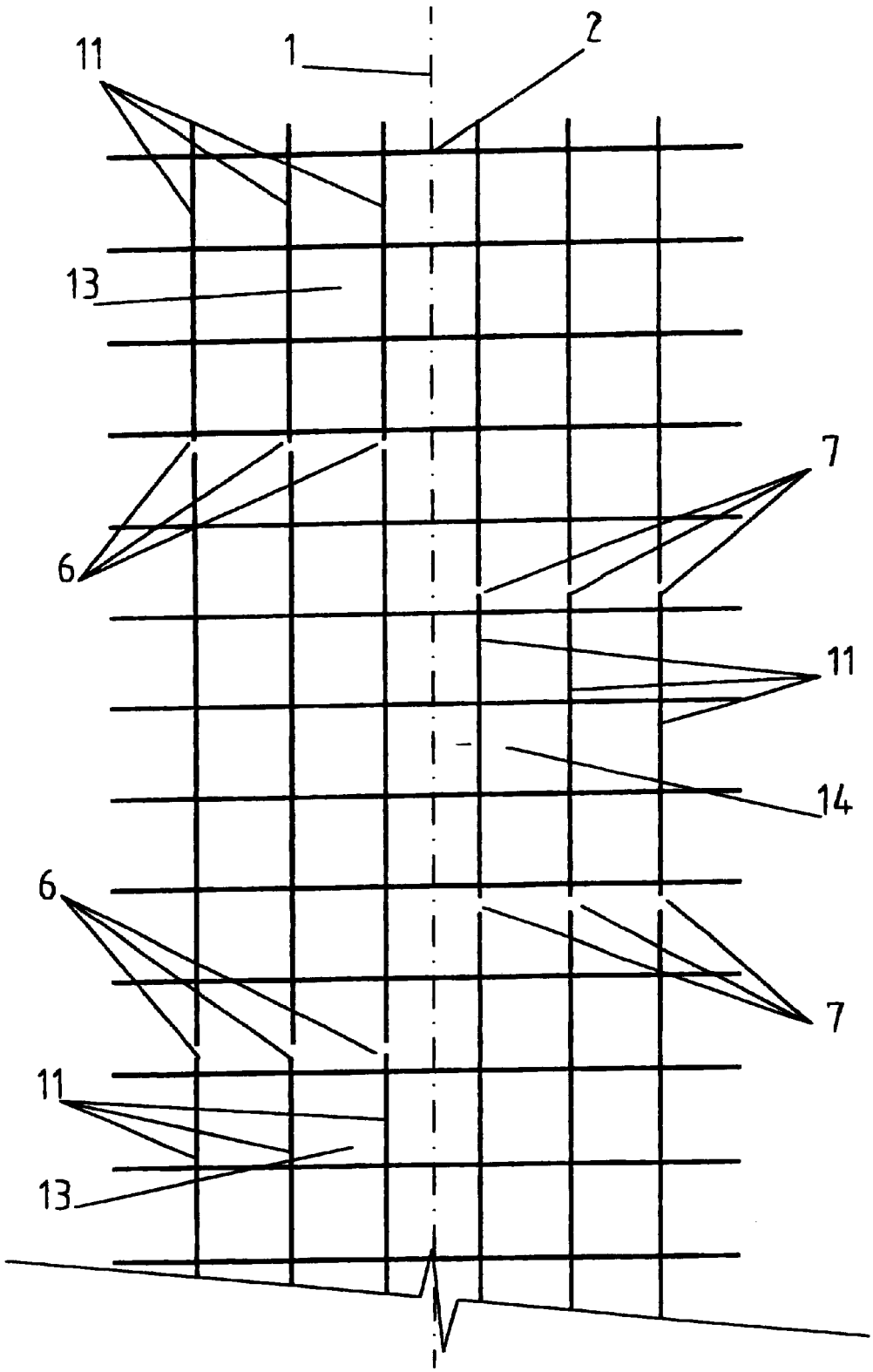
FIG. 1 represents the plan view of the mesh where the situation of the cuts made is observed.
Figure 2:
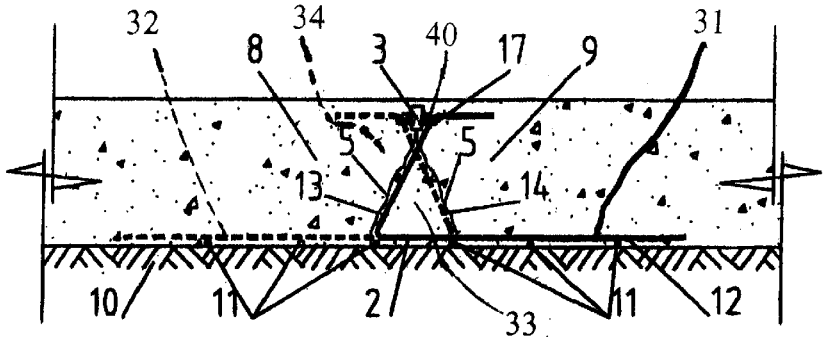
FIG. 2 shows a section perpendicular to the joint coinciding with a bent wire.
Figure 3:
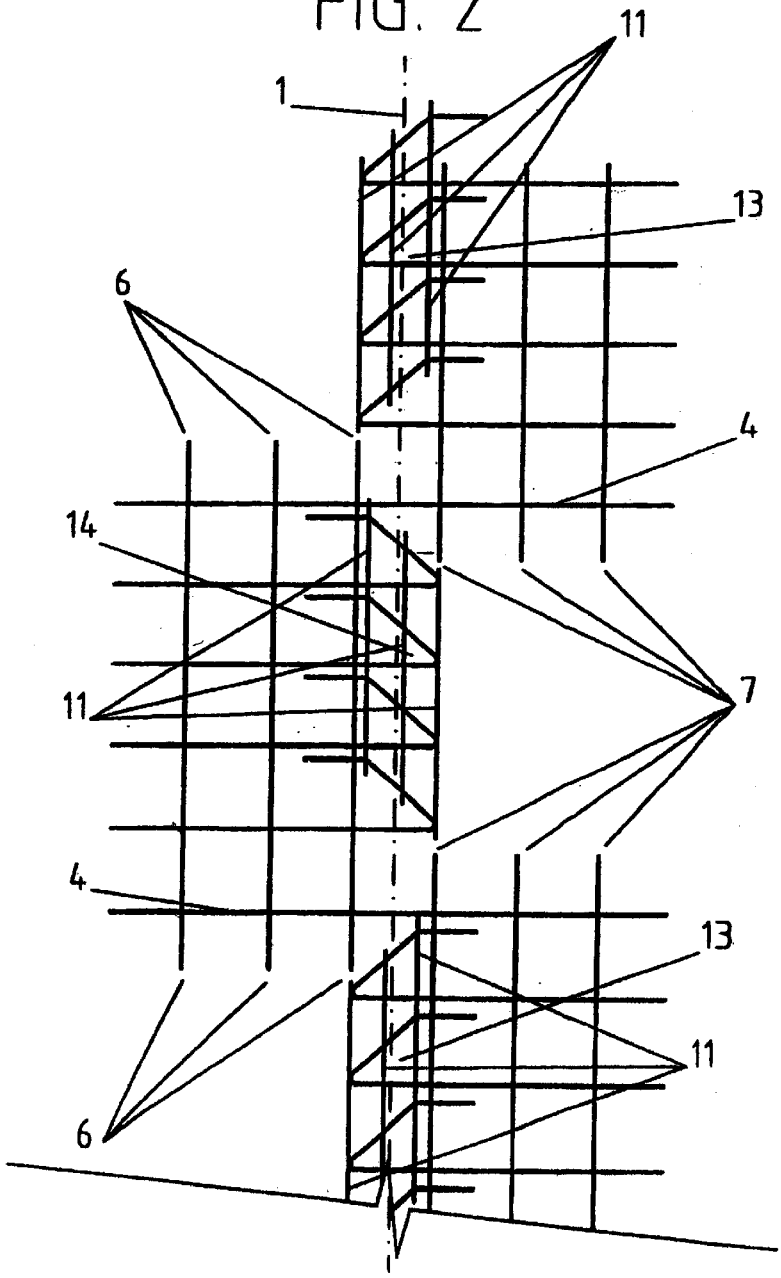
FIG. 3 represents the perspective plan view of a mesh.

In FIG. 1, we see the plan view of mesh 2 to be used to create the joint of FIG. 2, where the cuts 6 and 7 are indicated in the wires 11 to then bend the created parts 13 and 14, until leaving it with the shape shown in FIG. 3.

In FIG. 2, a corrugated steel mesh is shown over the ground 10 or next to it. The wires 11 of mesh 2 parallel to axis 1 will be cut in 6 and 7 alternatively on one of the other side. The mesh parts 13 and 14 between two successive cuts of the same wires are bent around a parallel wire and near to axis 1 of mesh 2 until the projection of the parallel wire and further away from the axis remains on the other side.

The process described to form the teeth 13 and 14 of mesh 2 admits other alternatives.

Figure 6:
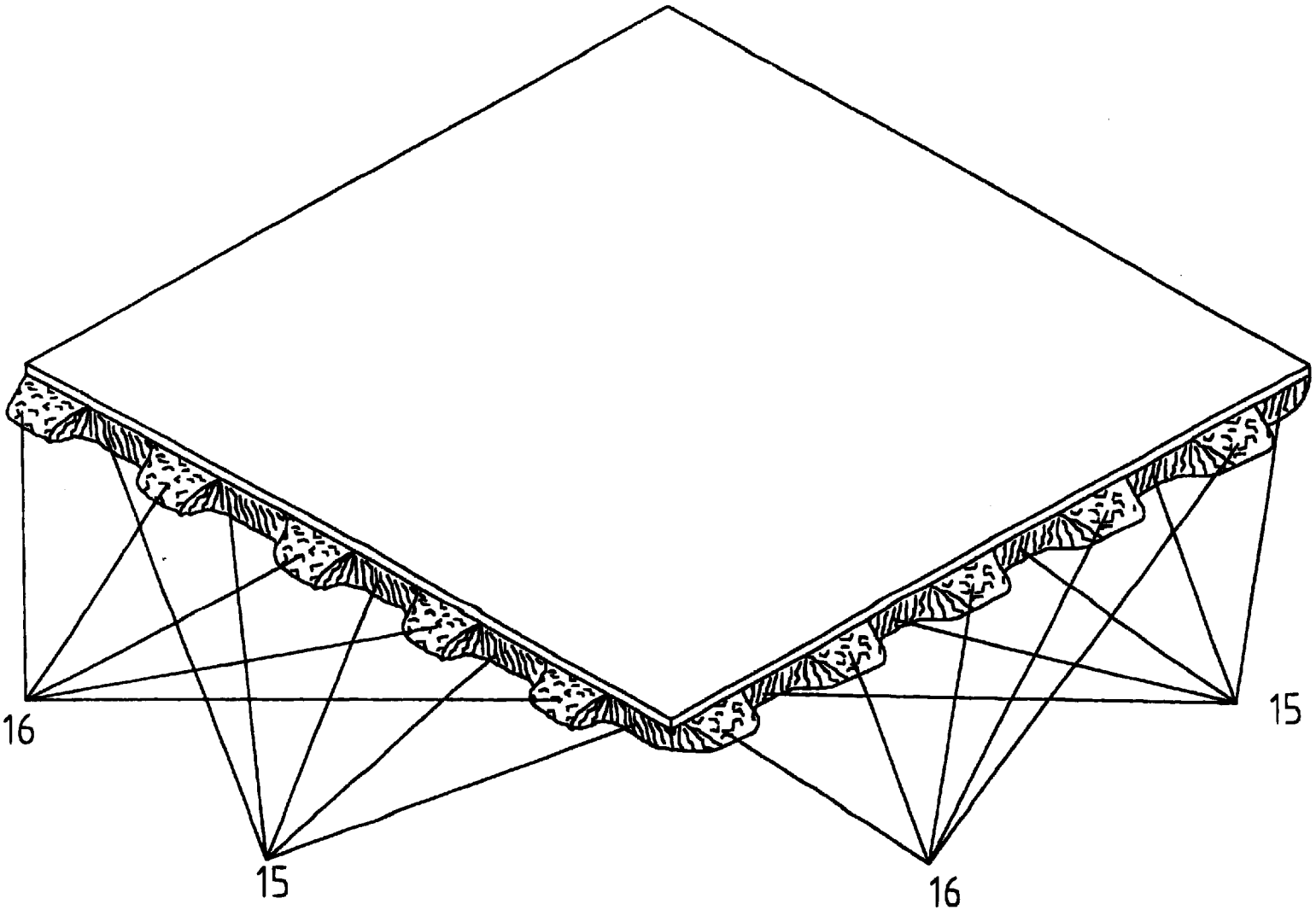
FIG. 6 represents the perspective view of an isolated slab, executed by the described process.
Figure 7:
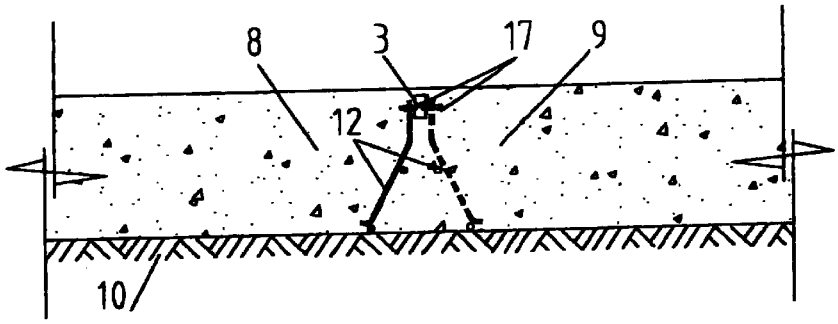
FIG. 7 shows section exclusively with the wires reinforcing the recessed zone and fastening the separating component.
Figure 8:
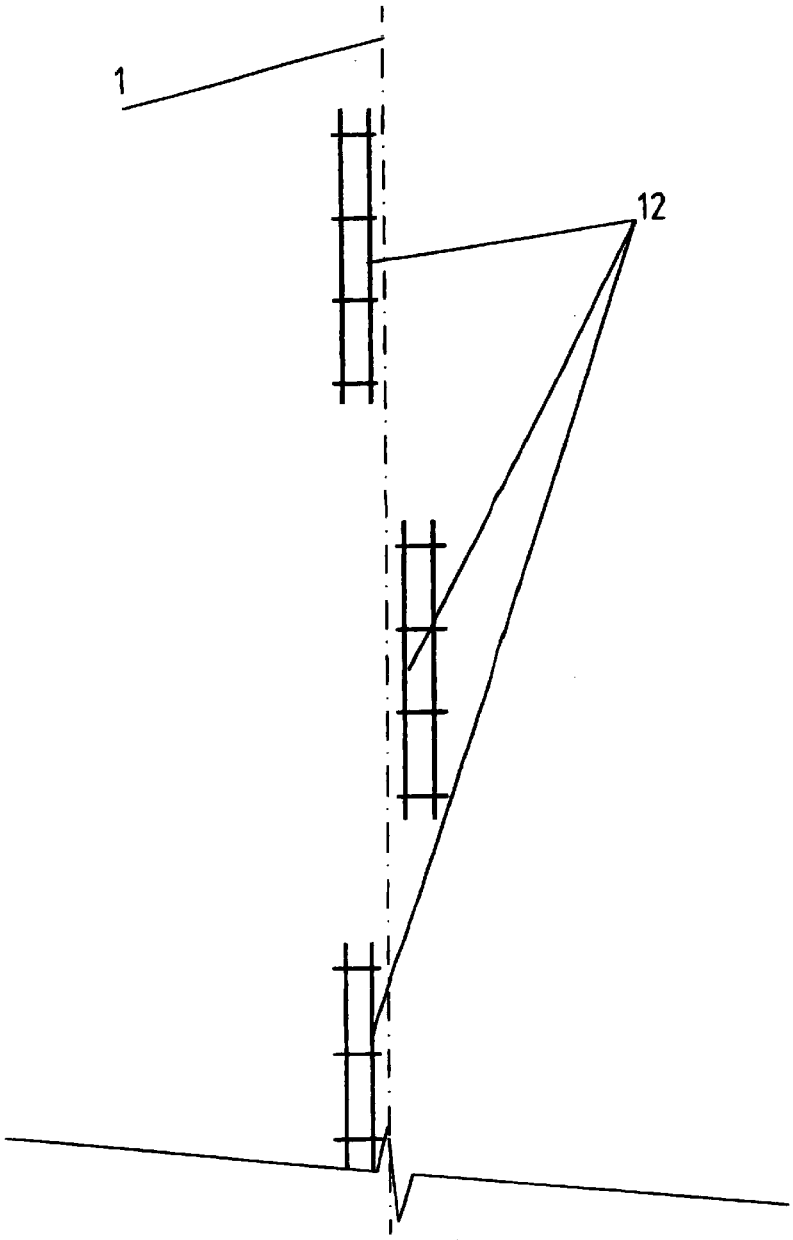
FIG. 8 is a plan view of the wires mentioned in FIG. 7.
Figure 9:
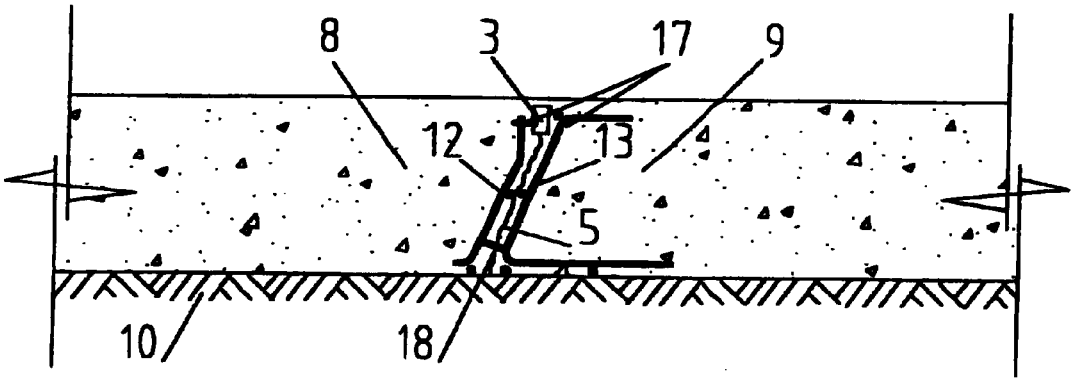
FIG. 9 shows the section with the device and the reinforcement of the recessed zone, having omitted the hidden lines.

In FIG. 3, the parallel wires may be omitted, as well as those at a greater distance from the axis leaning on the ground and this part 12 of mesh 2 may be taken advatage of to provide a reinforcement of the recessed zone 15 (FIG. 6) as seen in FIGS. 7 and 8, which may also be used for fastening, with a staple 17 or something similar, of the separating component 3, being located above the device object of the invention and being separated from it by a plastic part 18 or similar, according to FIG. 9 in which the steel rounds not seen in the section do not appear.

These teeth 13 and 14 should be made of corrugated steel or another material that adheres to the concrete and with a higher modulus of elasticity.

In the upper part of the crossarm left by the portions of bent mesh 13 and 14, the separating component 3 is located which may be fastened to said portions, if reinforcement of the recessed zones 15 is omitted.

Once the concrete has been laid, thanks to component 5 which weakens the section in which it is located and to alternatively bent mesh portions 13 and 14, both the shrinkage suffered by the concrete while it sets and loads which are applied latter on, will create a cracking surface alternatively inclined according to the bent mesh portions 13 and 14, forming recessed and exit zones 15 and 16 between slabs 8 and 9, left leaning over each other.

The wire 4, perpendicular to the axis 1 remaining between a recessed zone 15 and an exit zone 16 of a same slab, is not cut to serve as a joint between portions 13 and 14 which are formed in mesh 2, keeping it joined for it to be handled during displacement, location and robustness during concreting.

Figure 4:
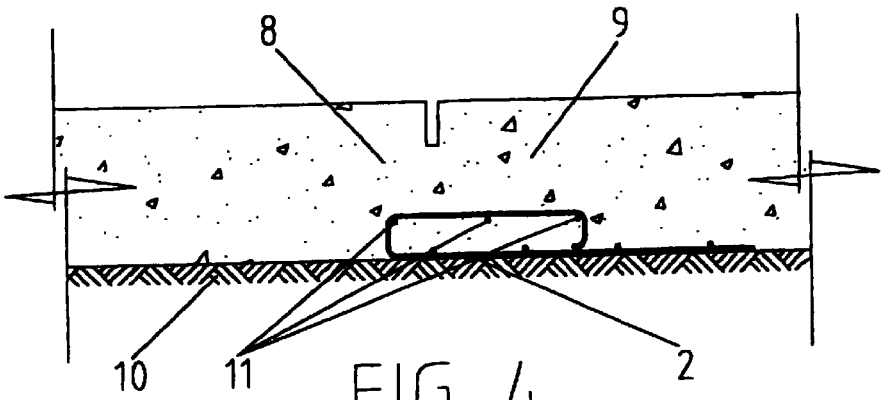
FIGS. 4 and 5 receptively show a section with another possible arrangement of the mesh and a plan view thereof, having omitted the hidden lines in FIG. 4.

In FIG. 4, a section is shown with another possible arrangement of mesh 2 for the formation of the joint. In this arrangement, the mesh axis coincides with a wire and the bent mesh portions 13 and 14 remain parallel to the ground.

Figure 5:
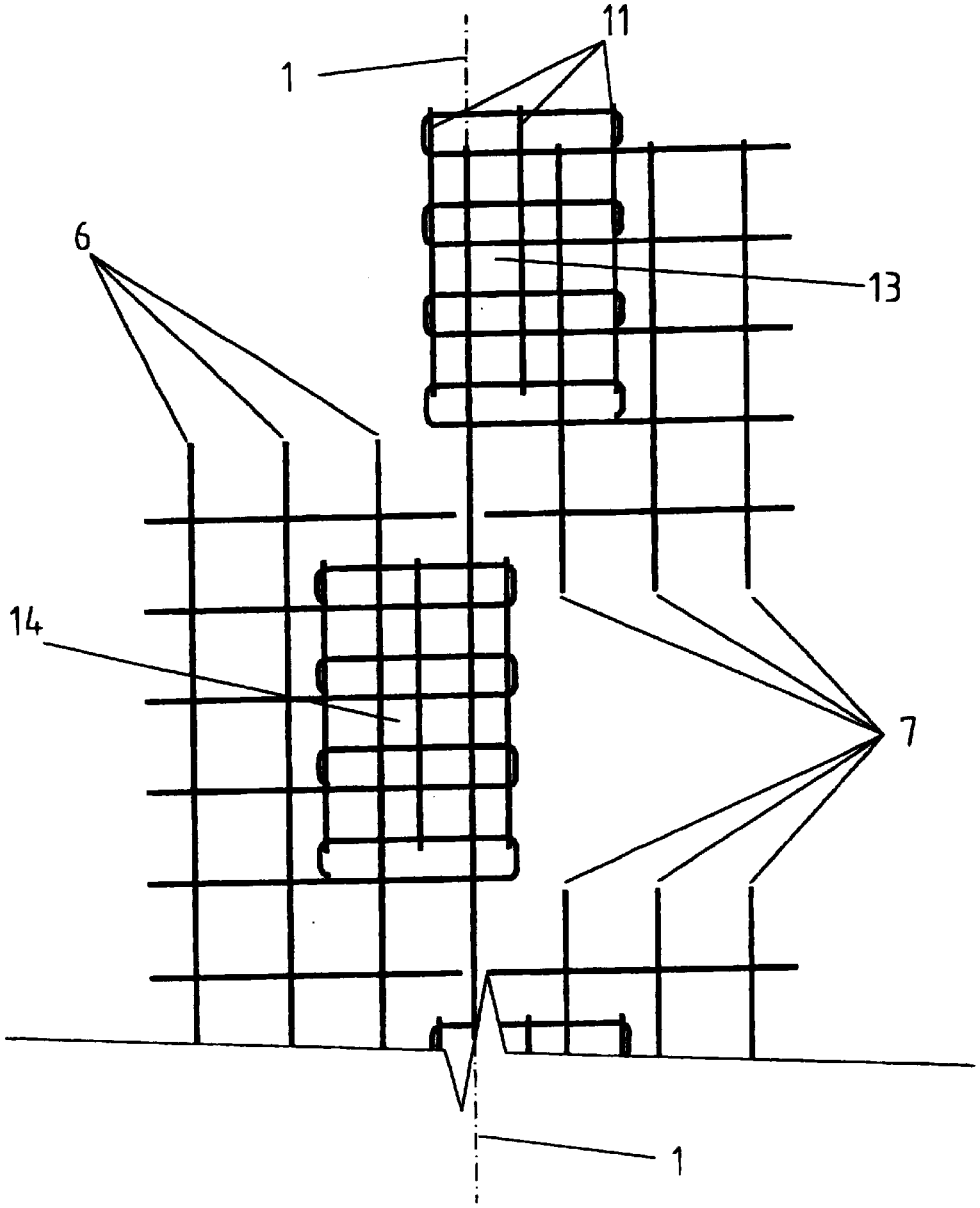

In FIG. 5, the perspective plan view of the previous mesh is shown, where it may be seen that in this case the wire without cut is that matching with axis 1 of mesh 2, the remaining cuts being similar to those of FIG. 3.

The alternative embodiment shown in FIGS. 4 and 5 would be applicable when the cracking of the concrete were to be produced basically by application of vertical loads in the weakened zone. In that case the cracked surfaces would form in inclined planes directed from the edges of blocks 13 and 14 towards the upper slit. Such alternative embodiment would not be applicable whenever cracking were to be expected due solely to shrinkage of the concrete which would follow a notably vertical line downwards from the upper slit.

The axis of component 3 will remain in the plane of axis 1 of the mesh perpendicular to the ground, the separating component being fastened to the bent mesh portions 13 and 14 and with its upper part flush or near to the paving surface. This closeness will make the execution of the superficial paving groove unnecessary, besides having the advantage of its correct location.

The separating component 3, besides weakening the section to form the cracking surface 5 which forms support zones 15 and 16 between slabs, may prevent the penetration of water through crack 5 by means of a waterproof joint, assuring that fines do not emerge due to the pumping effect.

The advantage provided by the process is that it eliminates the relative vertical movement between slabs due to the meshing produced between the surface aggregates resulting from cracking 5, so that pumping is also prevented. It also permits the execution of an upper aggregate layer without appearance of cracks in said layer.

This system not only replaces the traditional pins but permits to economize the base and sub-base layers which until now were necessary for heavy traffic.

The lateral sides or the slabs in which pins were normally not placed, may also be left with the proposed type of support, obtaining contour slab conditions which considerably reduce stressed, being possible to prepare slabs with less thickness but with the same structural resistance.

In FIG. 6, the perspective view of an isolated slab is shown, where the resulting cracking surface 5 may be seen, forming recessed and exit zones 15 and 16 which intermesh with adjacent slabs.

The process is the same if the separating component 3 is installed perpendicular to the ground, leaning on it; and mesh 2, with its part parallel to the ground, next to the paving surface. This is how it would be if the slab were turned round.

The process is similar if the broken line, formed by the wire cut, is created by the separating component 3 and mesh 2 is cut according to axis 1.

In use, an on-site joint forming process of the invention comprises the steps of:

a) providing joint forming elements as a mesh 2. The mesh comprises a plurality of wires 11, with each of said wires comprising a first elongate portion 31, 32 that is disposable along a surface to be paved and a second portion 13, 14 that is disposed at an angle relative to said first portion;

b) placing the plurality of wires on the surface to be paved at a site at which a joint is to be formed with a first set of the plurality of wires in a first zone 33 of the site and a second set of the plurality of wires in an adjoining zone 34 of the site and with the first set of the wires disposed along the surface in a first direction and the second set of the wires disposed along the surface in an opposite direction, said plurality of wires being constructed and disposed with respect to one another such that, upon pouring of concrete over the plurality of wires, and shrinking of the poured concrete, a joint is formed between adjoining concrete slabs with the slabs having a periodic arrangement of protrusions 16 and recessions 15 that prevents vertical movement between the slabs (see FIG. 6); and (c) pouring concrete over the plurality of wires so as to leave a weakened zone 40 in an upper part at the site at which the joint is to be formed and allowing the poured concrete to shrink with formation of the joint and adjoining concrete slabs.

What is claimed is:

1. An on-site joint forming process in concrete paving comprising:

a) providing a plurality of wires, each of said wires comprising a first elongate portion that is disposable along a surface to be paved and a second portion that is disposed at an angle relative to said first portion;

b) placing the plurality of wires on the surface to be paved at a site at which a joint is to be formed with a first set of the plurality of wires in a first zone of the site and a second set of the plurality of wires in an adjoining zone of the site and with the first set of the wires disposed along the surface in a first direction and the second set of the wires disposed along the surface in an opposite direction, said plurality of wires being constructed and disposed with respect to one another such that, upon pouring of concrete over the plurality of wires and shrinking of the poured concrete, a joint is formed between adjoining concrete slabs with the slabs having a periodic arrangement of protrusions and recessions that prevents vertical movement between the slabs; and (c) pouring concrete over the plurality of wires and allowing the poured concrete to shrink with formation of the joint and adjoining concrete slabs.

2. The process according to claim 1, comprising providing the plurality of wires with the angle between the first and second portions of each of said plurality of wires being an acute angle.

3. An on-site joint forming process in concrete paving comprising:

a) providing a plurality of wires, each of said wires comprising a first elongate portion that is disposable along a surface to be paved and a second portion that is disposed at an acute angle relative to said first portion;

b) placing the plurality of wires on the surface to be paved at a site at which a joint is to be formed with a first set of the plurality of wires in a first zone of the site and a second set of the plurality of wires in an adjoining zone of the site and with the first set of the wires disposed along the surface in a first direction and the second set of the wires disposed along the surface in an opposite direction, said plurality of wires being constructed and disposed with respect to one another such that, upon pouring of concrete over the plurality of wires and shrinking of the poured concrete, a joint is formed between adjoining concrete slabs with the slabs having an arrangement of protrusions and recessions that prevents vertical movement between the slabs; and c) pouring concrete over the plurality of wires and allowing the poured concrete to shrink with formation of the joint and adjoining concrete slabs.

4. The process according to claim 3, comprising placing the plurality of wires on the surface to be paved such that, upon pouring of concrete over the plurality of wires and shrinking of the poured concrete, the arrangement of the protrusions and recessions of the concrete slabs is periodic.

5. An on-site joint forming process in concrete paving comprising:

a) providing joint-forming elements (2) having a plurality of inclined meshed parts (13, 14), that are inclined in a common angle in relation to a plane perpendicular to a surface to be paved but in opposite direction in adjoining meshed parts (13, 14);

b) placing said joint-forming elements at a site at which a joint is to be formed such that, upon pouring of concrete over the joint-forming elements and shrinking of the poured concrete, a joint is formed between adjoining slabs (8,9) with the slabs having an arrangement of protrusions (16) and recessions (15) that prevents vertical movement between the slabs (8,9); and c) pouring concrete over the joint-forming elements so as to leave a weakened zone (40) in an upper part at the site at which a joint is to be formed for cooperating to form the joint and allowing the poured concrete to shrink with formation of the joint and adjoining concrete slabs.

6. The process according to claim 5, comprising placing the joint-forming elements such that, upon pouring of concrete over the joint-forming elements and shrinking of the poured concrete, the adjoining concrete slabs have an arrangement of protrusions and recessions that is periodic.

* * * * *